United States Patent [19]

Loomis

[11] Patent Number: 4,467,609

[45] Date of Patent: Aug. 28, 1984

[54] WORKING FLUIDS FOR ELECTRICAL GENERATING PLANTS

[76] Inventor: Robert G. Loomis, 116 Burdsall, Ft. Mitchell, Ky. 41017

[21] Appl. No.: 412,155

[22] Filed: Aug. 27, 1982

[51] Int. Cl.[3] ..... F01K 25/08

[52] U.S. Cl. ..... 60/651; 60/655; 252/67

[58] Field of Search ..... 60/651, 655, 671; 252/67

[56] References Cited

U.S. PATENT DOCUMENTS

| | | | |
|---|---|---|---|
| 3,516,249 | 6/1970 | Paxton | 60/655 X |
| 3,713,289 | 1/1973 | Smoekh | 252/67 X |
| 3,845,625 | 11/1974 | Schroder | 60/671 X |

*Primary Examiner*—Allen M. Ostrager

*Assistant Examiner*—Stephen F. Husar

*Attorney, Agent, or Firm*—Wood, Herron & Evans

[57] ABSTRACT

Halides of tungsten and molybdenum are described for use as working fluids in power plants. Specifically, tungsten pentachloride, tungsten hexachloride, molybdenum hexafluoride and molybdenum hexachloride are used as working fluids in power plants. These working fluids can be used alone in a single cycle. However, they are preferably used in one or two loops of a binary system. The working fluids can be used in combination with other known working fluids in a binary system. Specifically useful, working fluids would include water-Hg, aluminum iodide, water, and nitrogen tetroxide. The use of the novel boiler fluids of the present invention provide numerous advantages, particularly, improved efficiency.

7 Claims, 9 Drawing Figures

WORKING FLUIDS FOR ELECTRICAL GENERATING PLANTS

The present invention relates to the method of generating power by heating a working fluid, thereby increasing its volume and utilizing this increased volume to propel a turbine which runs an electrical generator or other power generating machine. More particularly, this invention relates to use of novel working fluids which provide increased efficiency over prior known working fluids.

The most common method of generating electrical power is by heating a working fluid, thereby increasing its temperature and pressure. The now gaseous working fluid at an elevated pressure is then allowed to expand in a controlled manner by passing through a turbine, thereby rotating the turbine blades and shaft which in turn powers a generator. Many working fluids have been used in the past. The first such working fluid was water. Other working fluids include nitrogen tetroxide, aluminum bromide, and various organic compounds as well as mixtures of compounds such as mercury-water. Today, water is still, by far, the most widely used working fluid. The problem employed when using water as a working fluid is that the efficiency of this system at higher temperatures is extremely poor. New power generating plants typically work in the neighborhood of 800°-1000° K. At these high operating temperatures, water is simply not an efficient working fluid. Even under optimum conditions, efficiencies remain less than 40%. The unused energy is removed by cooling towers.

This is even more of a problem in areas in which water is scarce and expensive. In these cooling towers, waste heat is removed by a water cooled heat exchanger. Much of this cooling water, due to its increased temperature, evaporates and is thereby lost. The water which does not evaporate is frequently returned to a river where it was obtained, thereby causing thermal pollution.

In addition, the use of water as a working fluid has several other inherent disadvantages. At 800°-1000° K., extremely high pressures in the range of 160 atmospheres must be used to efficiently provide work. Special equipment is required to handle these high pressures. Due to the low vapor density of water, large turbine sizes are required in order to efficiently obtain work from the water.

Other disadvantages typically associated with working fluids are high toxicity, high flammability, high corrosiveness and high viscosity. Increased viscosity, of course, increases operation costs due to the energy required to pump the fluid from the condenser to the heater.

An object of the present invention is to overcome the deficiencies of using water as a working fluid and also avoid the adverse consequences caused by other known alternative working fluids.

The present invention comprises using halides of tungsten and molybdenum as working fluids in power plants. More particularly, the present invention encompasses the use of tungsten pentachloride, tungsten hexachloride, tungsten hexafluoride and molybdenum hexafluoride as working fluids in power plants. This would include use of one or two of these novel working fluids in one or two loops of a binary system as well as using only one of these fluids in combination with other known fluids in a binary system. The chloride compounds can be efficiently used in temperature ranges exceeding 900° K. and with the fluoride compounds in a binary system use much in excess of 40% of the energy put into the system. Due to their high vapor density, smaller turbine sizes are required, thereby further decreasing the cost of the generation of energy. Further, since there is such high vapor density and since more of the available energy is actually used, smaller condensers are required. These boiler fluids further are low in viscosity. Therefore, the pumping costs are reduced. Further, these boiler fluids are not highly corrosive, toxic or flammable under the conditions used except as noted in the specification. Finally, the boiler fluids can be used over a wide range of temperatures, thereby facilitating the efficient use of the energy. These also would be quite useful in non-earth applications such as generating power in outer space. This is primarily due to this versatility and high vapor density.

DETAILED DESCRIPTION

Molybdenum hexafluoride, tungsten pentachloride, tungsten hexachloride and tungsten hexafluoride are used as working fluids in power generating plants. These fluids can be used either alone in a single loop system or together with a second working fluid in a binary system. Table I below shows the critical temperature and pressure for the four working fluids of the present invention. The critical temperature was calculated from entropy and enthalpy data provided by JANAF, *Thermochemical Tables*, Vols. 1-4, Dow Chemical Co., Midland, Mich. From the critical temperature, the critical pressure was derived using the Clausius Clapyron relationship.

TABLE I

| Working Fluid | Critical Temperature | Critical Pressure | Mol. Wt. |
|---|---|---|---|
| $MoF_6$ | 523° K. | 80.35 A | 209.93 |
| $WCl_5$* | 913° K. | 4104 PSI | 361.285 |
| $WCl_6$ | 1255° K. | 405.5 A | 396.57 |
| $WF_6$ | 632° K. | 430 A | 297.81 |

*dissociating gas

The thermodynamic characteristics of these working fluids are provided in JANAF, but have been calculated with the presumption that the fluids act as ideal gases.

These are shown in JANAF tables providing pressure enthalpy and entropy data over various temperature ranges. By calculating the entropy and enthalpy deviations, the actual entropy and enthalpies can be determined. These calculated actual entropies and enthalpies are shown in the FIGS. 1–4 for each of the working fluids of the present invention.

Figure 5:
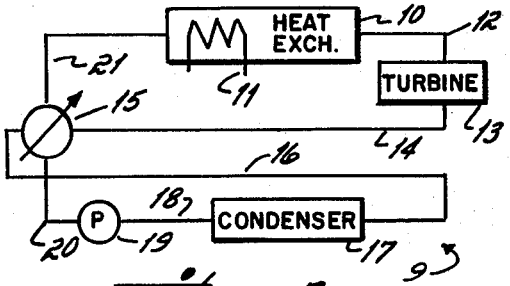
FIG. 5 is a schematic depiction of a single loop power generating plant employing $MoF_6$ as a working fluid.

Use of the molybdenum hexafluoride as the working fluid in a boiler plant is shown schematically in FIG. 5. The data shown in these diagrams and stated below was obtained from FIG. 1, and the work is calculated using the presumption that the turbine is 88% efficient and 1 mole of working fluid is being used.

FIG. 5 schematically depicts a power generating plant designed to employ molybdenum hexafluoride as the working fluid. The power plant 9 is a single loop system having a primary heat exchanger 10 which draws heat from line 11. The heat drawn through line 11 comes from a primary heat generating source which is not shown. The primary heat generating source would typically be the nuclear core of a nuclear power plant. In this case, a fluid such as sodium would be passed through lines 11. The primary heat source could also be the fire from a coal burning power plant. In this case, the heat exchanger would obtain heat directly from the burning coal.

The heat exchanger 10 includes an exit line or pipe 12 which passes to a turbine 13. Turbine 13 includes an exit line 14 which passes to a cross flow heat exchanger 15. Line 16 connects the cross flow heat exchanger 15 to a condenser 17 which is this case would be a cooling tower. Line 18 connects the condenser with a pump 19 which is connected through line 20 to the cross flow heat exchanger 15. The cross flow heat exchanger is then connected by line 21 to the primary heat exchanger 10.

In this schematic, the $MoF_6$ is passed through the exchanger 10 where the temperature of the $MoF_6$ is increased to about 710° K. at a pressure of 1000 psi. The fluid passes via line 12 from the heat exchanger to turbine 13 providing 48 cal/mole°K. of work. This leaves the entropy in the system at −14829 cal/mole°K. and with a temperature of 560° K.

The boiler fluid then passes via line 16 to the cross flow heat exchanger 15 where 84 cal/mole°K. of energy is removed to be transferred to the fluid entering the heat exchanger 15 through line 20. The cooled boiler fluid flows from the heat exchanger through line 16 to condenser 17 where the temperature of the fluid is reduced to 300° K. and 11.039 psi.

From the condenser 17, the fluid, which is now a liquid, flows via line 18 to a pump 19 which pumps the fluid through line 20 to the cross flow heat exchanger 15 which increases the temperature of the fluid to about 510° K. The preheated fluid flows in 21 from heat exchanger 15 to the primary heat exchanger 11 where its temperature is increased to 710° K. and 1000 psi.

The calculated efficiency for this system is 47.23%. The carnot efficiency is 57.7%. The carnot efficiency is the maximum efficiency that the system could operate at. The carnot relative efficiency, that is, the actual efficiency divided by the carnot efficiency, is 81.7%.

Figure 1:
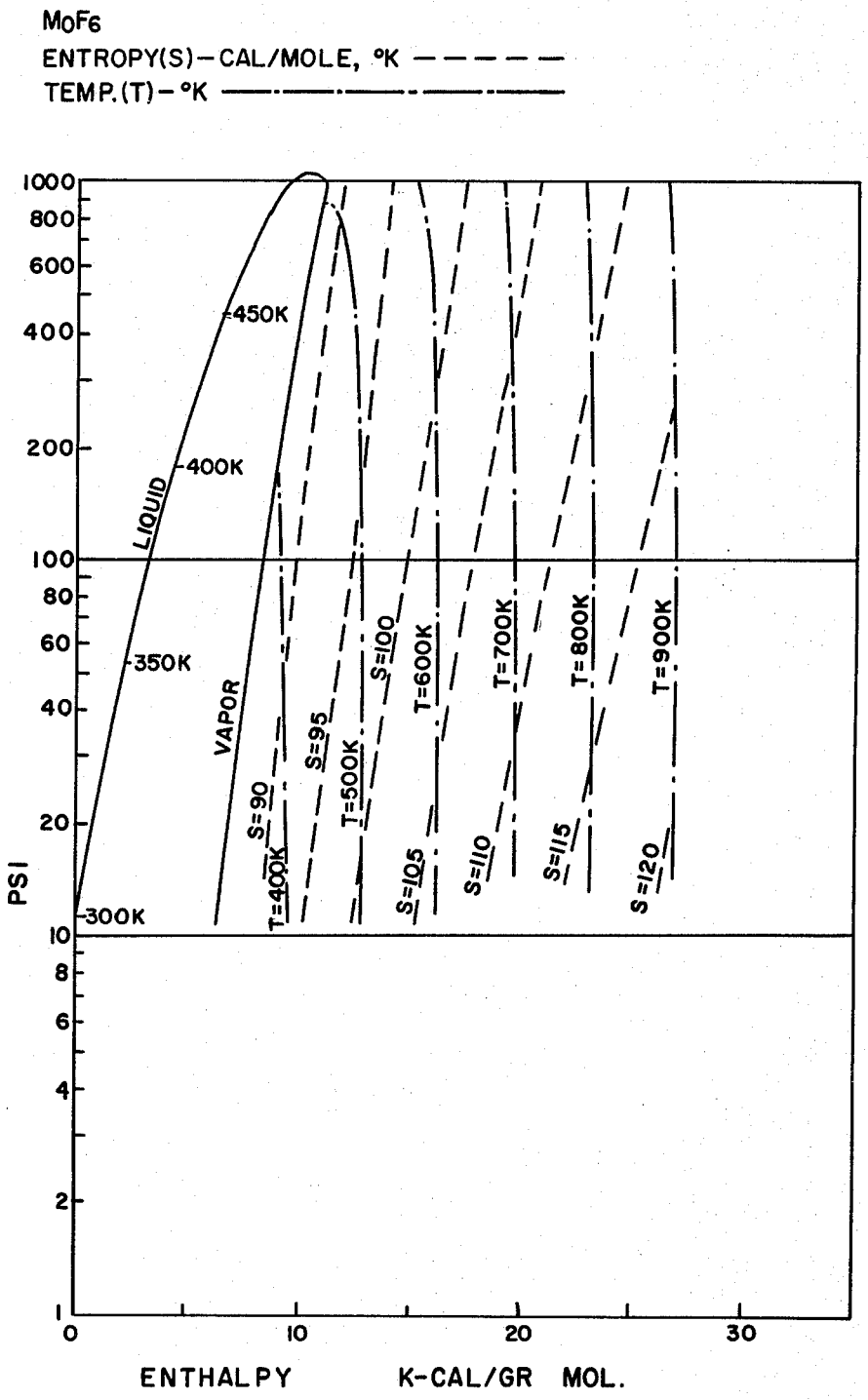
FIG. 1 is a graph of Pressure v. Enthalpy at constant temperature and also at constant entropy for $MoF_6$.
Figure 2:
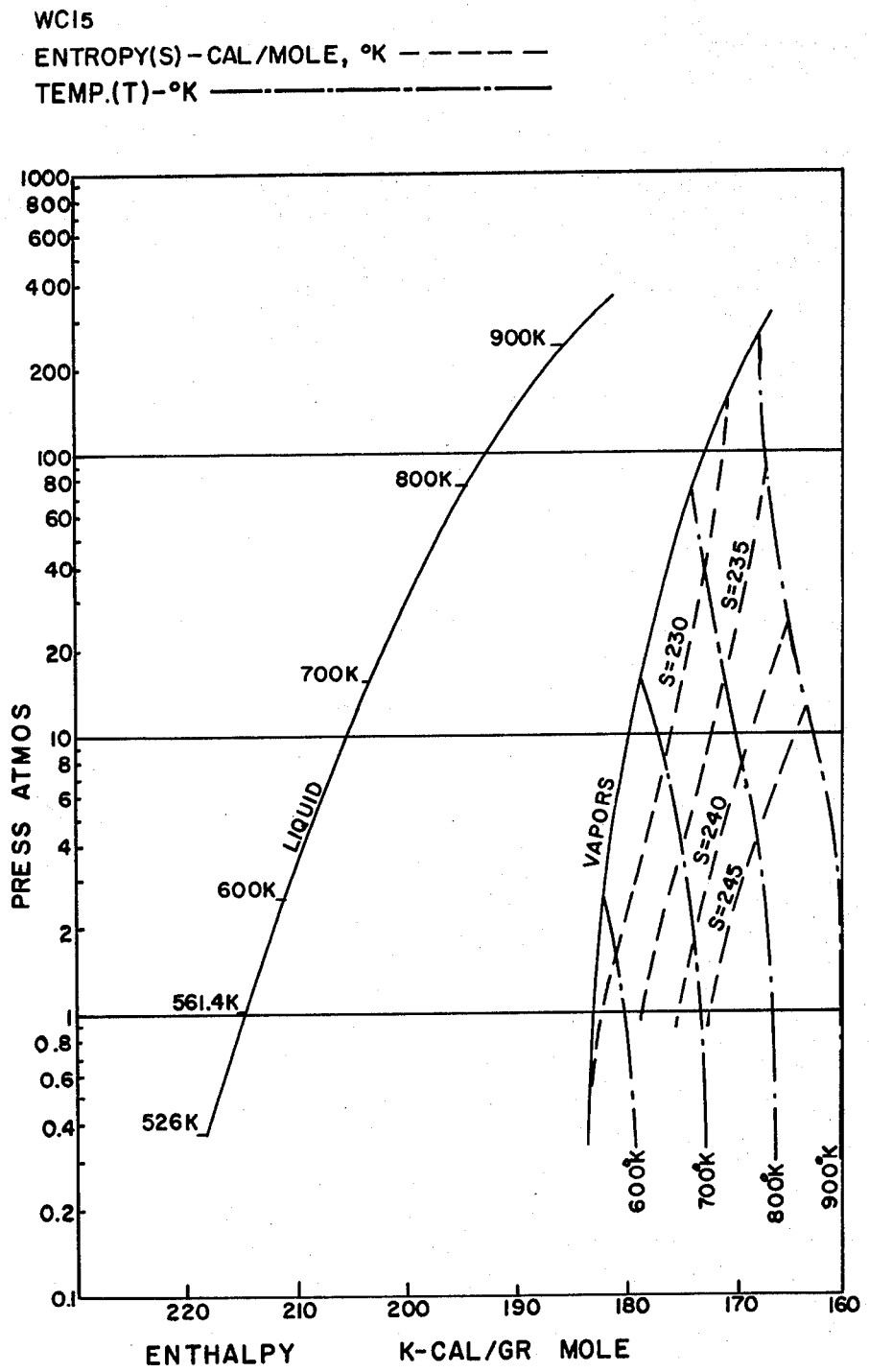
FIG. 2 is a graph of the Pressure v. Enthalpy at constant temperature and also at constant entropy for $WCl_5$.
Figure 6:
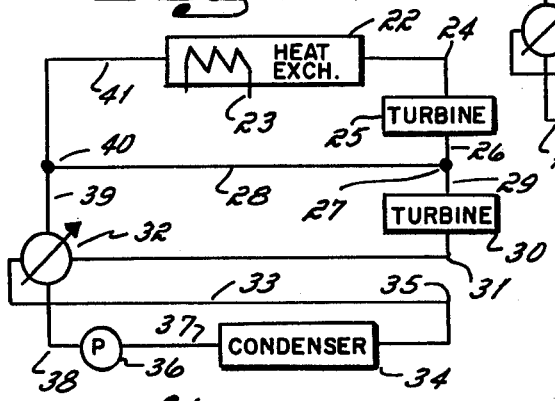
FIG. 6 is a schematic depiction of a single loop power generating plant employing $WCl_5$ as a working fluid.

The pressure enthalpy diagram for $WCl_5$ is shown in FIG. 2, and a working example is schematically demonstrated in FIG. 6. Tungsten pentachloride is particularly unique among the class of working fluids included in the present invention. Tungsten pentachloride is a dissociating gas. At higher temperatures, the tungsten pentachloride reacts to form a $W_2Cl_{10}$. The working range of tungsten pentachloride is from about 900° K. to about 550° K.

FIG. 6 depicts a single loop system 1 for the generation of electrical power using tungsten pentachloride as a working fluid. The system includes the primary heat exchanger or heater 22 which draws energy from a primary heat source via lines 23 similar to lines 11 in FIG. 5. The primary heat exchanger 22 is connected via line 24 with a turbine 25. Turbine 25 includes an exit line 26 which connects to a bleed-off valve 27 which permits a portion of the fluid to be bled off via line 28, the remaining fluid to continue through line 29 to turbine 30. Turbine 30 includes an exit line 31 which communicates with a cross flow heat exchanger 32 which includes an exit line for the cooled fluid 33 which in turn is connected to a condenser 34 via line 35. The condenser, or cooling heat exchanger, is connected to a pump 36 via line 37. Pump 36 includes an exit line 38 which is directed to the cross flow heat exchanger 32 which includes an exit line for the heated fluid 39 which is connected in turn to admitting valve 40 which connects lines 28 and 39 and directs the combined fluids flowing in these lines through line 41 to the primary heat exchanger 22.

As shown in FIG. 6, the working fluid enters the primary heat exchanger where its temperature is raised to 900° K. with a pressure of 2000 psi. The working fluid then flows to and through turbine 25, where controlled expansion produces 28.2 cal/mole°K. of work. After passing through the first turbine, 30.8 molar percent of the total working fluid, which is at 500 psi, is directed through valve 27 into line 28 to admitting valve 40. This acts to preheat the fluid in line 39. The remaining fluid passes through valve 27 to a second turbine 30, where controlled expansion produces 65.67 cal/mole°K. of heat. From this second turbine, the working fluid flows via line 31 to a cross flow heat exchanger 32 and preheats the fluid in line 38. The cooled fluid is directed from the cross flow heat exchanger 32 to condenser 34, lowering the temperature to 530° K. at 6 psi. The working fluid, after passing from the condenser via line 37, is pumped 36 through line 38 to the cross flow heat exchanger where its temperature is raised from 530° K. to 580° K. The preheated fluid flows from the heat exchanger 32 via line 39 to valve 40 where the heated fluid from line 28 is added to the fluid in line 39, thereby making the temperature of fluid in line 41 730° K. This fluid is then directed via line 41 to the primary heat exchanger 22 to continue the cycle. The efficiency of this system is calculated to be 29.32 whereas the carnot efficiency is 41.1, leaving the carnot relative efficiency at 71.3.

Figure 3:
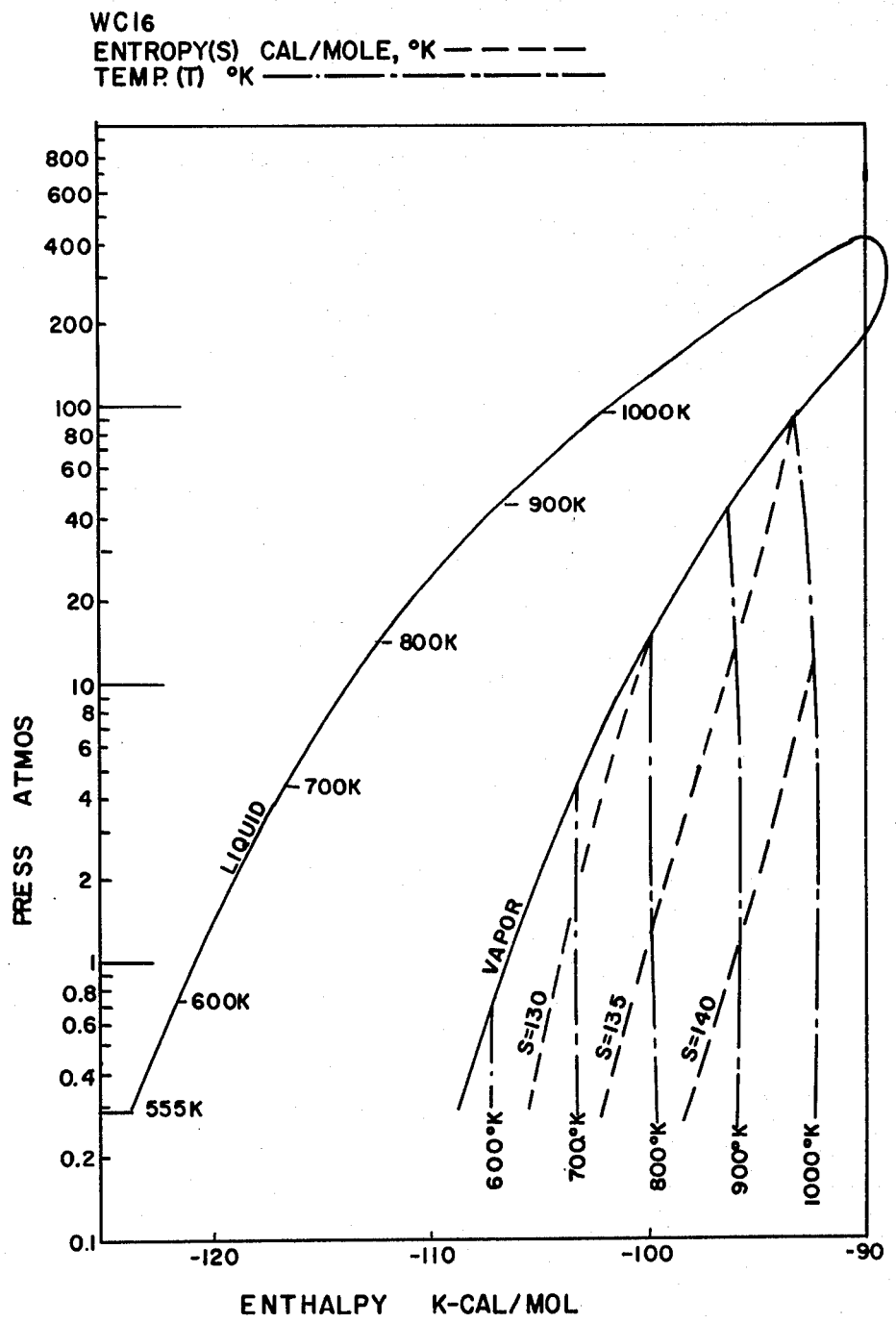
FIG. 3 is a graph of the Pressure v. Enthalpy at constant temperature and also at constant entropy for $WCl_6$.
Figure 7:
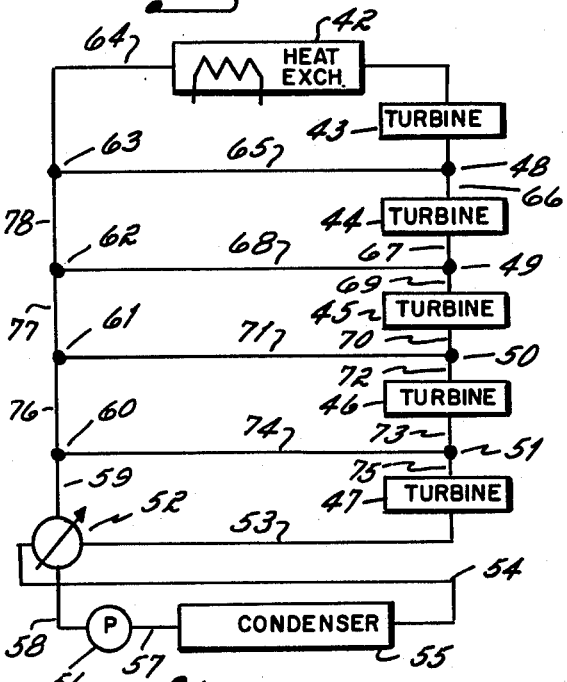
FIG. 7 is a schematic depiction of a single loop power generating plant employing $WCl_6$ as a working fluid.

With the data contained in FIG. 3, working examples of the use of tungsten hexachloride can be determined. This example is schematically shown in FIG. 7. As shown in FIG. 7, the system includes a primary heat exchanger 42 connected to a series of turbines 43, 44, 45, 46 and 47. The lines exiting turbines 43, 44, 45 and 46 connect to bleed-off valves 48, 49, 50 and 51, respectively, which bleed off a portion of the heated fluid from the lines allowing the remaining to pass forwardly to the next turbine. The final turbine 47 is connected to a cross flow heat exchanger 51 via line 53 and the cross flow heat exchanger in turn is connected via line 54 to a condenser unit 55. Condenser unit 55 is connected to a pump 56 via line 57, and the pump in turn is connected to the cross flow heat exchanger 52 via line 58. A line 59 exiting the cross flow heat exchanger is connected to the first of a series of accepting valves 60, 61, 62 and 63 which are connected to bleed-off valves 51, 50, 49 and 48, respectively via lines 74, 71, 68 and 65. A line 64 connects the final accepting valve 63 to the primary heat exchanger 42. This makes this fluid particularly suited within the 900°-560° K. range.

The working fluid enters the heat exchanger 42 from line 64 where the temperature of the working fluid is increased to 900° K. The enthalpy of the working fluid at this point is −96.5 Kcal/mole°K. The working fluid then pass from heat exchanger 42 to the first turbine 43 wherein controlled expansion generates 440 cal/mole°K. The enthalpy of the fluid at this point is −96.94 Kcal/mole°K. with a temperature of 850° K. and a pressure of 26.25 A.

The working fluid passes from turbine 43 to a first bleed-off valve 48 where 15.77 molar percent of the working fluid is bled off through line 65 and directed to accepting valve 63. The remaining working fluid passes through bleed-off valve 43 through line 66 to the second turbine 44. Again, controlled expansion generates 592 cal/mole°K. of work. The fluid exiting the turbine via line 67 has a temperature of 800° K. and pressure of 15.45 atmospheres. Line 67 directs the working fluid to bleed-off valve 49 where 11.98 molar percent of the working fluid is directed through line 68 to accepting valve 62. The remaining working fluid passes from bleed-off valve 49 through line 69 to third turbine 45.

In the third turbine 45, controlled expansion generates 572 cal/mole°K. of work leaving the temperature of the fluid exiting the turbine via line 70 at 750° K. and 8.47 atmospheres. The fluid exiting via line 70 passes to a bleed-off valve 50 where 9.4 molar percent of the working fluid is bled off and directed through line 71 to accepting valve 61. The remaining fluid is allowed to pass from the bleed-off valve 50 through line 72 to fourth turbine 46.

In turbine 46, controlled expansion creates 829 cal/mole°K. of work leaving the fluid exiting the turbine via line 73 at 700° K. with a pressure of 4.26 atmospheres. The fluid passing through line 73 is directed to bleed-off valve 51 which directs 5.43 molar percent of the working fluid through line 74 to accepting valve 60.

The remaining working fluid passes to the fifth turbine 47 via line 75 where controlled expansion generates 1818 cal/mole°K. heat. The fluid exiting turbine 47 is directed via line 53 to a cross flow heat exchanger which reduces the temperature of the working fluid passing in through line 53. The cooled working fluid exits the heat exchanger 52 via line 54 where it is passed to a condenser 55 where the temperature is reduced to 560° K.

The condensed working fluid exits the condenser via 57 and flows to a pump 56 which directs the working fluid via line 58 to the cross flow heat exchanger 52 which increases the temperature of the working fluid entering from line 58. The heated working fluid then passes via line 59 to accepting valve 60 where the 5.43 percent of the fluid bled off from valve 51 is added to the fluid passing through line 59. This combined working fluid in turn passes via line 76 to the second accepting valve 61 which combines the fluid directed by bleed-off valve 50 via line 71 with the fluid in line 76. The combined fluid flows from the accepting valve 61 through line 77 to a third accepting valve 62 which accepts the fluid from the bleed-off valve 49 via line 68. The combined fluid is then passed to a fourth accepting valve 63 where the fluid bled off by bleed-off valve 48 through line 65 is mixed with the fluid entering from line 78. The combined working fluid from accepting valve 63 is then passed via line 64 back to the primary heat exchanger 42. Based on the work produced, the efficiency of this system is 31.67%.

Tungsten hexachloride is notable in that it doubles in volume when it goes below 443° K. This is due to a change in the crystalline structure of the compound. Therefore, when using this compound as boiler fluid, one must take precautions to avoid damaging the boiler when it is being shut down. Specifically, pressure release mechanisms must be included in the system to allow the expanding tungsten pentachloride to escape the boiler.

Figure 4:
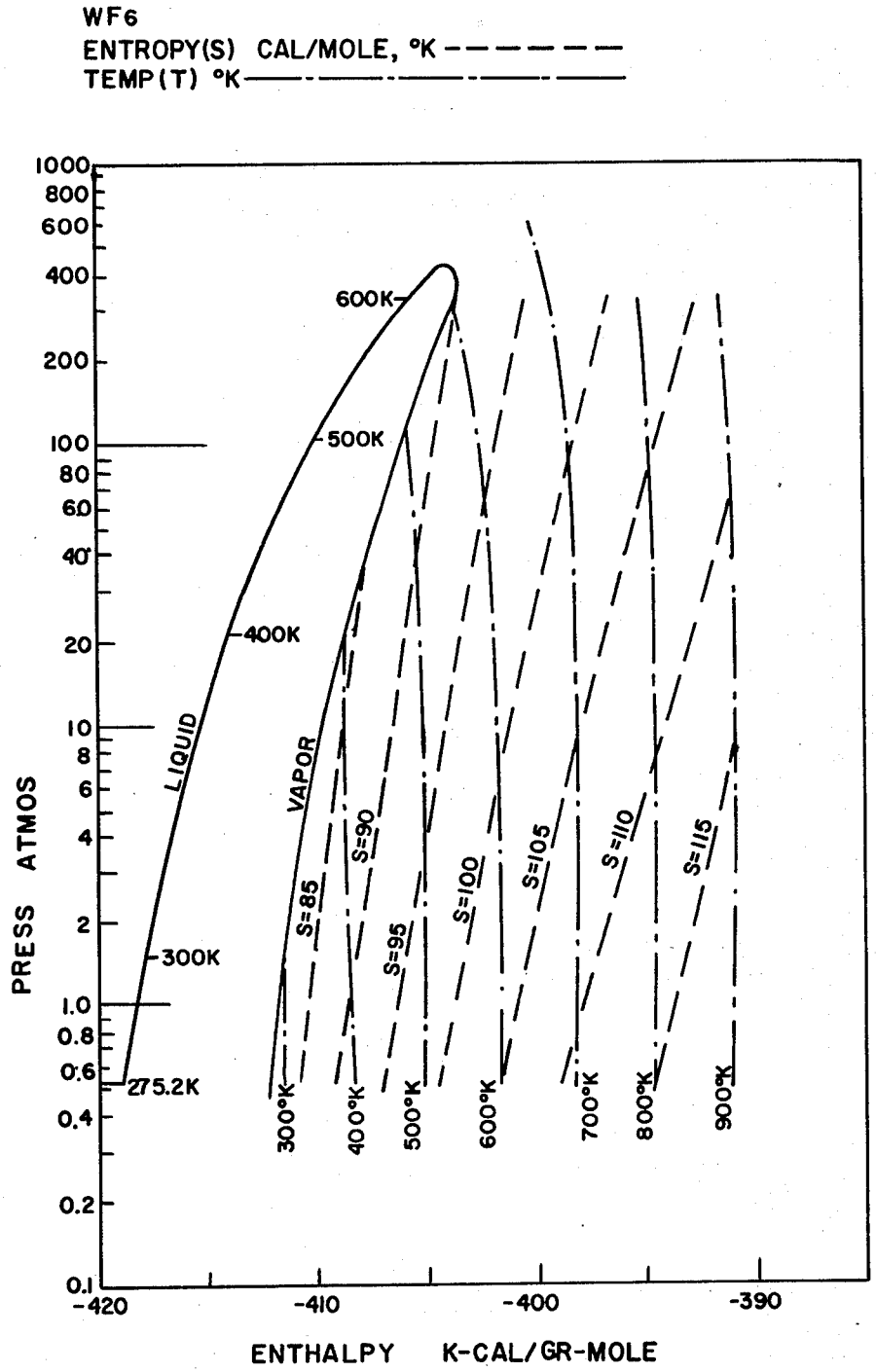
FIG. 4 is a graph of the Pressure v. Enthalpy at constant temperature and also at constant entropy for $WF_6$.
Figure 8:
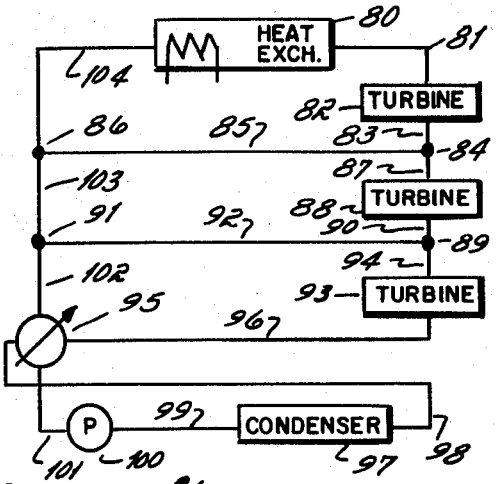
FIG. 8 is a schematic depiction of a single loop power generating plant employing $WF_6$ as a working fluid.

FIG. 4 shows the pressure enthalpy chart for tungsten hexafluoride. The information contained in this chart was then used to derive this schematic example shown in FIG. 8. FIG. 8 schematically describes a power plant using tungsten hexafluoride as a working fluid in combination with three turbines and three bleed-in lines.

The system is a simple loop system which includes a primary heat exchanger 80 connected via line 81 to a first turbine 82 which in turn is connected via line 83 to a bleed-off valve 84. Bleed-off valve 84 directs a portion of the fluid passing therethrough via line 85 to an accepting valve 86. The remaining fluid is directed via line 87 to the second turbine 88 which in turn is connected via line 90 to a second bleed-off valve 89. Bleed-off valve 89 is connected to an accepting valve 91 via line 92 and to a third turbine 93 via line 94. Third turbine 94 is connected to a cross flow heat exchanger 95 via line 96. This cross flow heat exchanger is then in turn connected to a condenser 97 via line 98. Line 99 connects condenser 97 to pump 100. Pump 100 is then connected by line 101 to the cross flow heat exchanger 95 which in turn is connected to accepting valve 91 via line 102. Accepting valve 91 is connected via line 103 to accepting valve 86 which in turn is connected via line 104 to the primary heat exchanger 80.

Referring to FIG. 8, a preheated working fluid is admitted into a primary heat exchanger 80 through line 104 and the temperature of the fluid is raised to 540° K. and a pressure of 178 A. The fluid passes from the primary heat exchanger 80 through line 81 to first turbine 82 where it generates 400 calories/mole°K. of work by means of controlled expansion. The fluid at this point has a temperature of 500° K. and pressure of 110 A. The fluid passes from turbine 82 through line 83 to a bleeder valve 84. Bleeder valve 84 directs 47.12 molar percent of the fluid through line 85 to an accepting valve 86.

The remaining 52.87% of the working fluid passes through bleeder valve 84 through line 87 to second turbine 88 where it generates 57.9 calories/mole°K. of work by means of controlled expansion. The temperature of the fluid as it flows from the turbine is 400° K. with a pressure of 21 A. From turbine 88, the fluid passes through line 90 to a second bleeder valve 89 which bleeds off 11.0 molar percent of the total working fluid through line 92 to accepting valve 91. The remaining 41.87% of the fluid passes through valve 89 through line 94 to this turbine 93 generating 921.23 cal/mole°K. of work.

The fluid then passes from turbine 83 through line 96 to cross flow heat exchanger 95 which cools the working fluid down to 310° K. The fluid flows from cross flow heat exchanger 95 through through line 98 to a condenser 97 which lowers the temperature to 290.3° K. and one atmospheric pressure.

The condensed fluid passes from condenser 97 through line 99 to a pump 100. Pump 100 forces the fluid to the cross flow heat exchanger 95 via line 101 where its temperature is raised. The heated fluid then passes via line 102 to an accepting valve 91 where fluid from line 92 is added to the fluid in line 102. The fluid then passes from valve 91 through line 103 to second accepting valve 86 where the 47% of the working fluid bled off by valve 84 through line 85 is mixed with the working fluid in line 103. This working fluid is then passed from valve 86 through line 104 to the primary heat exchanger 80 where its temperature is again raised to 540° K. and 58 A. The efficiency of this system is calculated to be 35.63%.

The preferred method of using these boiler fluids lies in the use of these in a binary system. The binary system has a top loop and a bottom loop. The top loop is a continuous enclosed system where a working fluid passes through a heat exchanger, turbine and condenser to continuously drive the turbine.

Unlike a single loop system, with the binary system, the condenser of the top loop is a cross flow exchanger which also acts as the primary heat exchanger for the bottom loop.

The bottom loop includes a line directing fluid through this cross flow heat exchanger. It is heated by the waste heat from the first working fluid in the top loop. It then passes through a turbine and a cooling unit into a pump forming a continuous path for the fluid.

Binary systems can be much more efficient than a single loop system since the waste heat from the top loop is not discarded, but rather is absorbed by the fluid in the bottom loop and used to produce work. This substantially increases the overall efficiency of the system. In a binary system, it is extremely important that the working fluid in the primary loop and the working fluid in the secondary loop be compatible. In order to be compatible, the fluid, having passed through the turbine in the top loop, must be hot enough to heat the material in the bottom loop to a temperature at which you can efficiently produce work.

Figure 9:
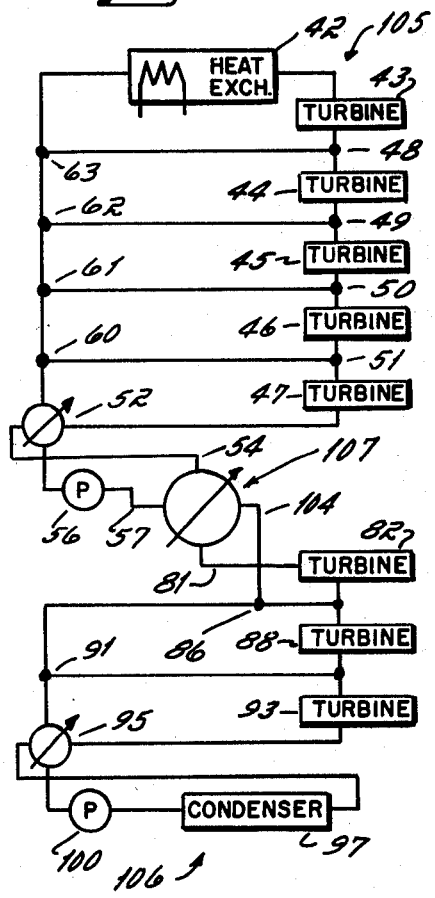
FIG. 9 is a schematic depiction of a binary loop power generating plant.

FIG. 9 is a schematic of an exemplary binary system where the primary working fluid in the top loop 105 is tungsten hexachloride and the working fluid in a botom loop 106 is molybdenum hexafluoride. Top loop 105 is identical in structure and operation to the loop shown in FIG. 7 and described above. The only change is that the condenser 55 in FIG. 7 is replaced by a cross flow heat exchanger 107. This condenses the boiler fluid entering through line 54. The bottom loop 106 is identical to the system described and shown in FIG. 8 with the exception that the primary heat exchanger 80 is replaced by the cross flow heat exchanger 107 so that fluid entering cross flow heat exchanger 107 through line 104 is increased to the operating temperature and then exits through line 81. By using this method, the efficiency of the system shown in FIG. 8 is equal to the combined efficiencies of the systems shown in FIGS. 7 and 8 or 54%. Table II below shows effective temperature ranges of various working fluids which could be used in one loop of a binary system in combination with the novel working fluids of the present invention.

TABLE II

| Compound | Efficient Working Range |
|---|---|
| $MoF_6$ | 540–307.4° K. |
| $WCl_5$ | 900–550° K. |
| $WCl_6$ | 900–560° K. |
| $WF_6$ | 540–290.3° K. |
| $AlI_3$ | 900–658° K. |
| $N_2O_4$ | 300° F.–69.2° F.(32.4) |
| FC88 | 440° F.–100° F. (.286) |
| F-11 | 330–100 (23%) |
| Pentane | 500–100 (31.1%) |
| $I_2$ | 1000–280 (37.8) |
| Hg | 1000° F.–750° F. (9.32%) |
| $H_2O$ | 1000° F.–100° F. |
| $FC_{75}$ | 550–310° K. (36.0) |

[1]Perfluoro-2-butyltetrahydrofuran
[2]Fluorocarbon refrigerant

Table III below shows a series of combinations of working fluids used in binary systems and the efficiencies calculated therefrom. All these combinations are combinations in which at least one of the working fluids is one of the claimed working fluids of the present invention.

TABLE III

| Binary Systems | | | | | | |
|---|---|---|---|---|---|---|
| Primary/Range/Eff. | | | Secondary/Range/Eff. | | | Comb. |
| Cpd | | | Cpd | | | Eff. |
| $WCl_5$ | 900–561° K. | 22.9 | $MoF_6$ | 525–300° K. | 27.8 | 50.7 |
| $WCl_6$ | 900–560 .34A | 29.6 | $MoF_6$ | 525–300 .75A | 25.3 | 54.9 |
| $WCl_6$ | 900–560 1A | 31.6 | $MoF_6$ | 540–350 | 23.22 | 54.8 |
| $WCl_6$ | 900–613 .34A | 26.9 | $H_2O$ | 609° F.–101° F. | 25.0 | 51.4 |
| $WCl_6$ | 900–560 | 31.7 | $WF_6$ | 540–290 | 24.4 | 56.0 |
| $WCl_6$ | 900–560 | 31.7 | $WF_6$ | 540–300° K. | 22.5 | 54.2 |
| $WCl_6$ | 900–560 | 31.7 | Pentene | 540–300° K. | 21.3** | 53.0 |
| $WCl_6$ | 900–560 1A | 31.78 | FC75* | 550–310 | 24.6** | 56.32 |
| $AlI_3$ | 900–658 | 24.2 | $WF_6$ | 635–300 | 27.0** | 51.2 |

*FC75 is a trademark of 3M.
**Calculated without substantial temperature allowance.

I claim:

1. The method of converting heat energy to mechanical energy which comprises vaporizing a first fluid by passing said first fluid in a heat exchange relationship with a heat source and utilizing the kinetic energy of the resulting expanding vapors to perform work, wherein said first fluid is selected from the group consisting of molybdenum hexafluoride, tungsten pentachloride, tungsten hexachloride and tungsten hexafluoride.

2. The method of claim 1 wherein said first fluid is tungsten hexachloride.

3. The method claimed in claim 1 wherein said fluid is tungsten pentachloride.

4. The method of converting heat energy to mechanical energy which comprises vaporizing a first fluid by passing said fluid in heat exchange relationship with a heat source and utilizing the kinetic energy of the resulting expanding vapors to perform work and subsequently passing a second fluid in heat exchange relationship with said first fluid and utilizing the kinetic energy of the resulting expanding vapors to perform work wherein either said first or said second fluid is selected from the group consisting of molybdenum hexafluoride, tungsten pentachloride, tungsten hexachloride and tungsten hexafluoride.

5. The method claimed in claim 4 wherein said first fluid is tungsten hexachloride and said second fluid is selected from the group consisting of molybdenum hexafluoride, tungsten pentachloride and tungsten hexafluoride.

6. The method claimed in claim 4 wherein said first fluid is tungsten pentachloride and said second fluid is selected from the groups consisting of molybdenum hexafluoride and tungsten hexafluoride.

7. The method claimed in claim 4 wherein said first fluid is aluminum trichloride and said second fluid is selected from the group consisting of molybdenum hexafluoride, tungsten pentachloride, tungsten hexachloride and tungsten hexafluoride.

* * * * *